US007588094B2

(12) United States Patent
Lin

(10) Patent No.: US 7,588,094 B2
(45) Date of Patent: Sep. 15, 2009

(54) POWER HAND TOOL

(75) Inventor: Yung-Tsung Lin, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 128 days.

(21) Appl. No.: 11/984,909

(22) Filed: Nov. 26, 2007

(65) Prior Publication Data

US 2009/0065227 A1 Mar. 12, 2009

(51) Int. Cl.
*B25D 11/04* (2006.01)

(52) U.S. Cl. ..... 173/48; 173/178; 173/216; 173/217

(58) Field of Classification Search ..... 173/176, 173/178, 48, 216, 217, 201
See application file for complete search history.

(56) References Cited

U.S. PATENT DOCUMENTS 4,898,249 A * 2/1990 Ohmori ..... 173/176
5,025,903 A * 6/1991 Elligson ..... 192/83
5,842,527 A * 12/1998 Arakawa et al. ..... 173/48
6,142,242 A * 11/2000 Okumura et al. ..... 173/48
6,230,819 B1 * 5/2001 Chen ..... 173/48
6,520,267 B2 * 2/2003 Funfer et al. ..... 173/48
6,691,796 B1 * 2/2004 Wu ..... 173/48
6,892,827 B2 * 5/2005 Toyama et al. ..... 173/48
7,225,884 B2 * 6/2007 Aeberhard ..... 173/93.5
7,314,097 B2 * 1/2008 Jenner et al. ..... 173/48
7,410,007 B2 * 8/2008 Chung et al. ..... 173/48
7,513,845 B2 * 4/2009 Ho ..... 475/298

* cited by examiner

*Primary Examiner*—Scott A. Smith
(74) *Attorney, Agent, or Firm*—Bacon & Thomas, PLLC

(57) ABSTRACT

A power hand tool includes a housing; an electric motor mounted in the housing for provide a rotary motion; a transmission gear set is mounted in the housing and connected with the electric motor; a torsion control device having a first rotary knob, which can adjust the maximum torsion output of the transmission gear set while being turned, and a plurality of first dents formed on an internal periphery thereof; an impact device having a second rotary knob, which can switch on or off an impact motion generated on the transmission gear set while being rotated, and a plurality of second dents formed on an internal periphery thereof; and a locating device having a holder fixed to the torsion control device and a locating member mounted to the holder, the locating member having two resilient portions, each of which has a convexity engaged with the associated first dents or second dents.

8 Claims, 4 Drawing Sheets

POWER HAND TOOL

BACKGROUND OF THE INVENTION

1. Field of the Invention

The present invention relates generally to power hand tools, and more particularly, to a power hand tool capable of adjusting torsion and impacting a workpiece.

2. Description of the Related Art

A conventional power impact wrench is primarily composed of an electric motor, a transmission gear set, and an impact device. The transmission gear set is to decelerate the rotary motion of an output shaft of the electric motor down to a predetermined rotary speed and then to output it via the output shaft. The impact device is to apply a rapid discontinuous impact having the same rotary direction as the output shaft does to the output shaft so as to enable the output shaft to overcome the resistance and to keep working.

A conventional power screwdriver is primarily composed of an electric motor, a transmission gear set, and a torsion regulator. The transmission gear set is to decelerate the rotary motion of the output shaft of the electric motor down to a predetermined rotary speed and then to output it. The torsion regulator is to adjust the maximum torsion outputted by power hand tool to avoid damage to a workpiece.

The above-mentioned impact device and torsion regulator are applicable to users' needs to the contrary separately because these two devices generally do not exist in the same power hand tool. However, under few special circumstances, the two devices are needed at the same time. For example, when the user operates a power wrench to dismantle a tire from a car, to overcome the obstacle resulted from rusty bolts or other causes, the power wrench needs the impact device; when the user installs the tire onto the car, to prevent overgreat torsion output of the power hand tool from damage to the bolts provided for fastening the tire onto the car, the power hand tool needs the torsion regulator. However, if the two devices are combined into the same power hand tool, the number of elements and the size of the power hand tool will be inevitably increased to be defective.

SUMMARY OF THE INVENTION

The primary objective of the present invention is to provide a power hand tool, which includes a torsion regulator and an impact device at the same time, wherein the torsion regulator and the impact device share some elements or components to decrease required elements and size of the power hand tool.

The foregoing objective of the present invention is attained by the power hand tool composed of a housing, an electric motor, a transmission gear set, a torsion control device, an impact device, and a locating device. The electric motor is mounted in the housing for provide a rotary motion. The transmission gear set is mounted in the housing and connected in transmission with the electric motor, for decelerating the rotary motion output of the electric motor down to a predetermined speed and then outputting it via an output shaft. The torsion control device includes a base, a rotary disk, and a first rotary knob. The base is connected with the transmission gear set and located in the housing. The rotary disk is mounted to the base, rotatable on a rotary center of the output shaft and axially movable along the output shaft. The axial movement of the rotary disk can adjust the maximum torsion output of the output shaft. The first rotary knob is mounted to the housing, rotatable on the rotary center of the output shaft, and connected with the rotary disk for driving rotation of the rotary disk while being turned. The first rotary knob has an internal periphery and a plurality of first dents formed on the internal periphery thereof. The impact device includes a switch and a second rotary knob. The switch is mounted in the housing, of reciprocating rotation on the rotary center of the output shaft. One reciprocating rotation of the switch can switch on or off an impact motion against the output shaft. The second rotary knob is mounted to the housing, rotatable on the rotary center of the output shaft. The second rotary knob is connected with the switch for driving rotation of the switch while being rotated. The second rotary knob further has an internal periphery and a plurality of second dents formed on the internal periphery thereof. The locating device includes a holder and a locating member. The holder is fixed to the base of the torsion control device. The locating member has two separate base portions and two resilient portions parallel connected between the two base portions respectively. Each of the resilient portions has a convexity. The base portions of the locating member are mounted to the holder, the two resilient portions facing internal peripheries of the first and second rotary knobs respectively, the convexities of the two resilient portions engaging with the first dents or the second dents when the first rotary knob or the second rotary knob is turned.

DETAILED DESCRIPTION OF PREFERRED EMBODIMENTS

Figure 1:
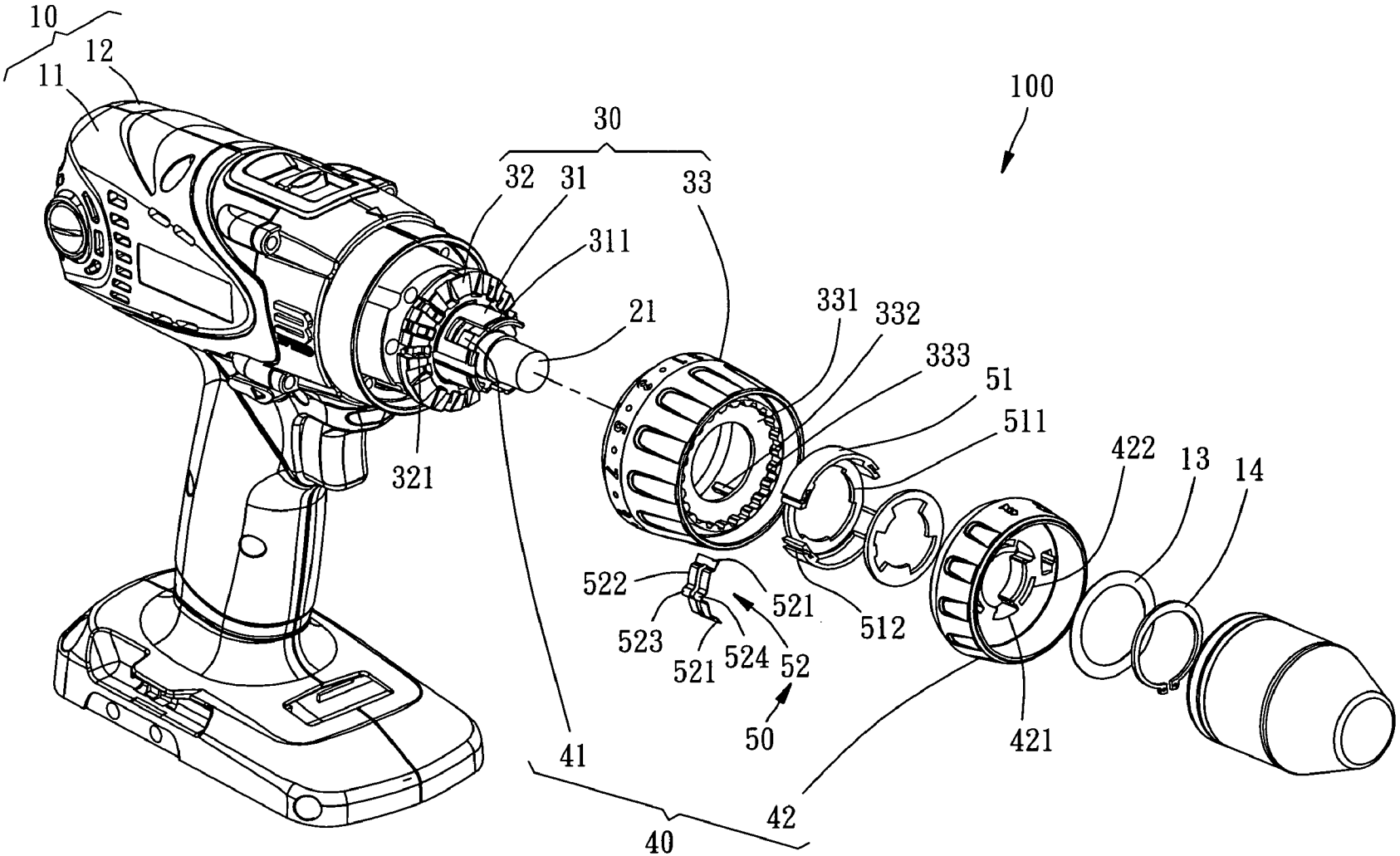
FIG. 1 is an exploded view of a preferred embodiment of the present invention.
Figure 2:
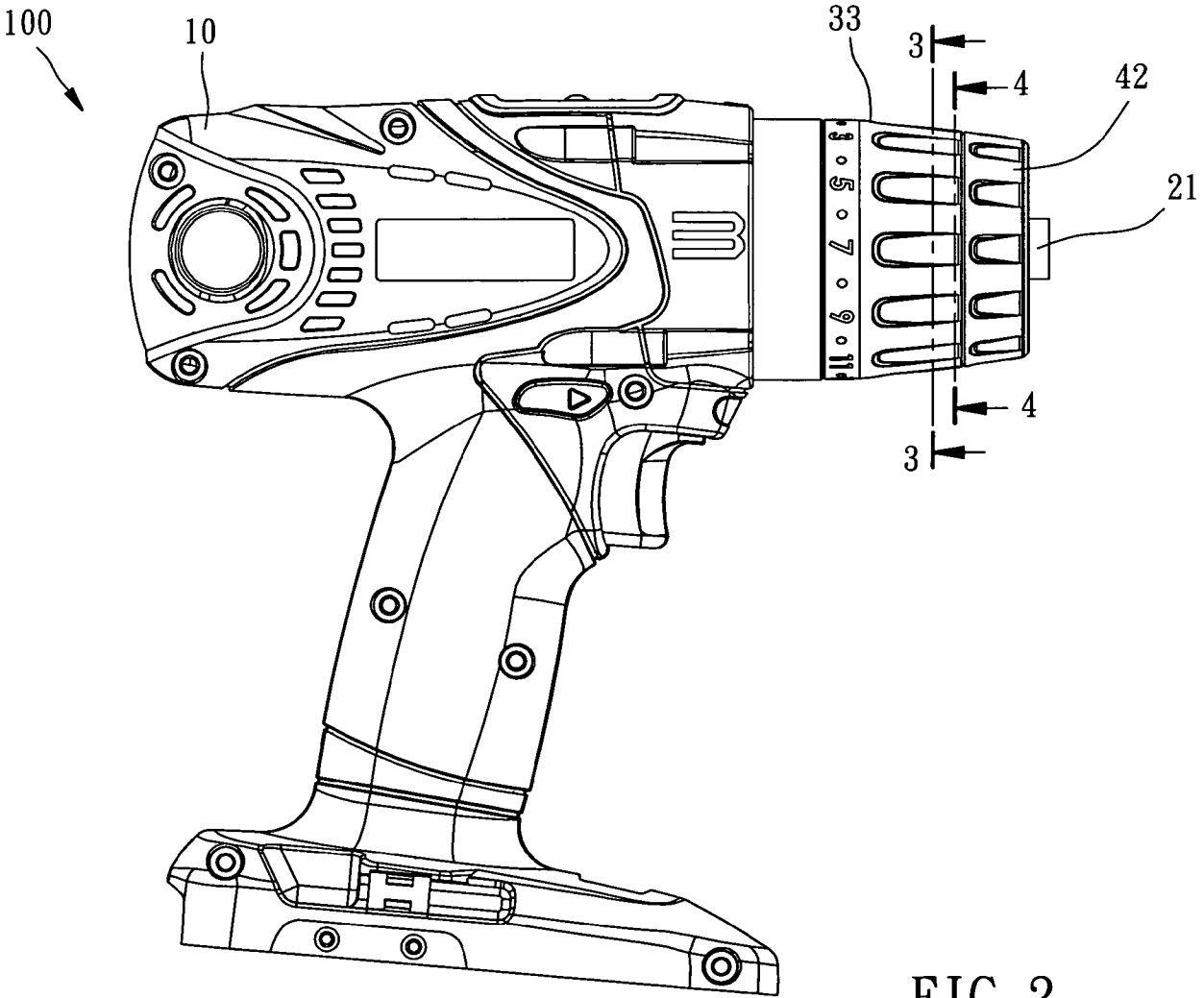
FIG. 2 is a side view of the preferred embodiment of the present invention.
Figure 3:
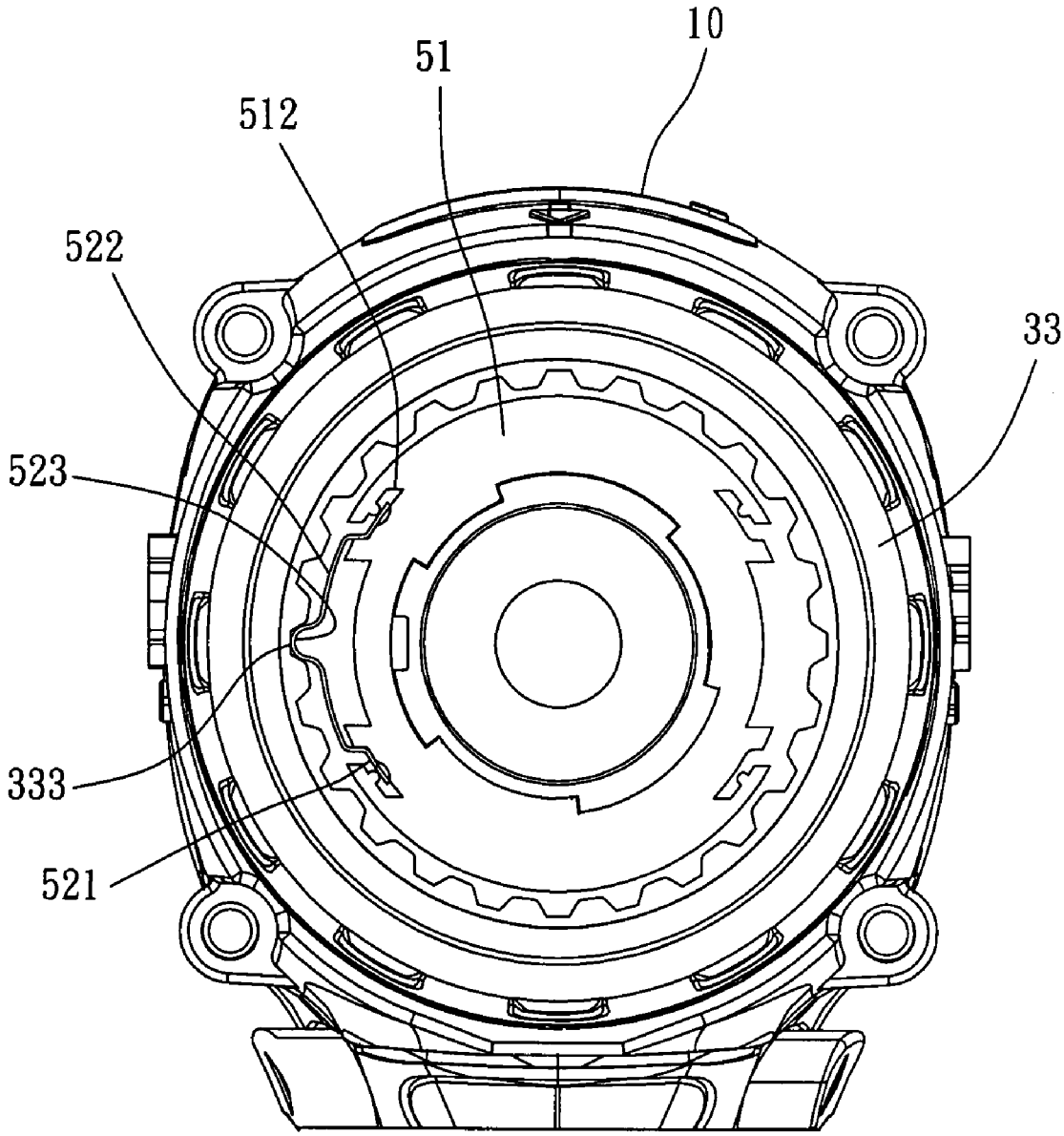
FIG. 3 is a sectional view taken from a line 3-3 indicated in FIG. 2.
Figure 4:
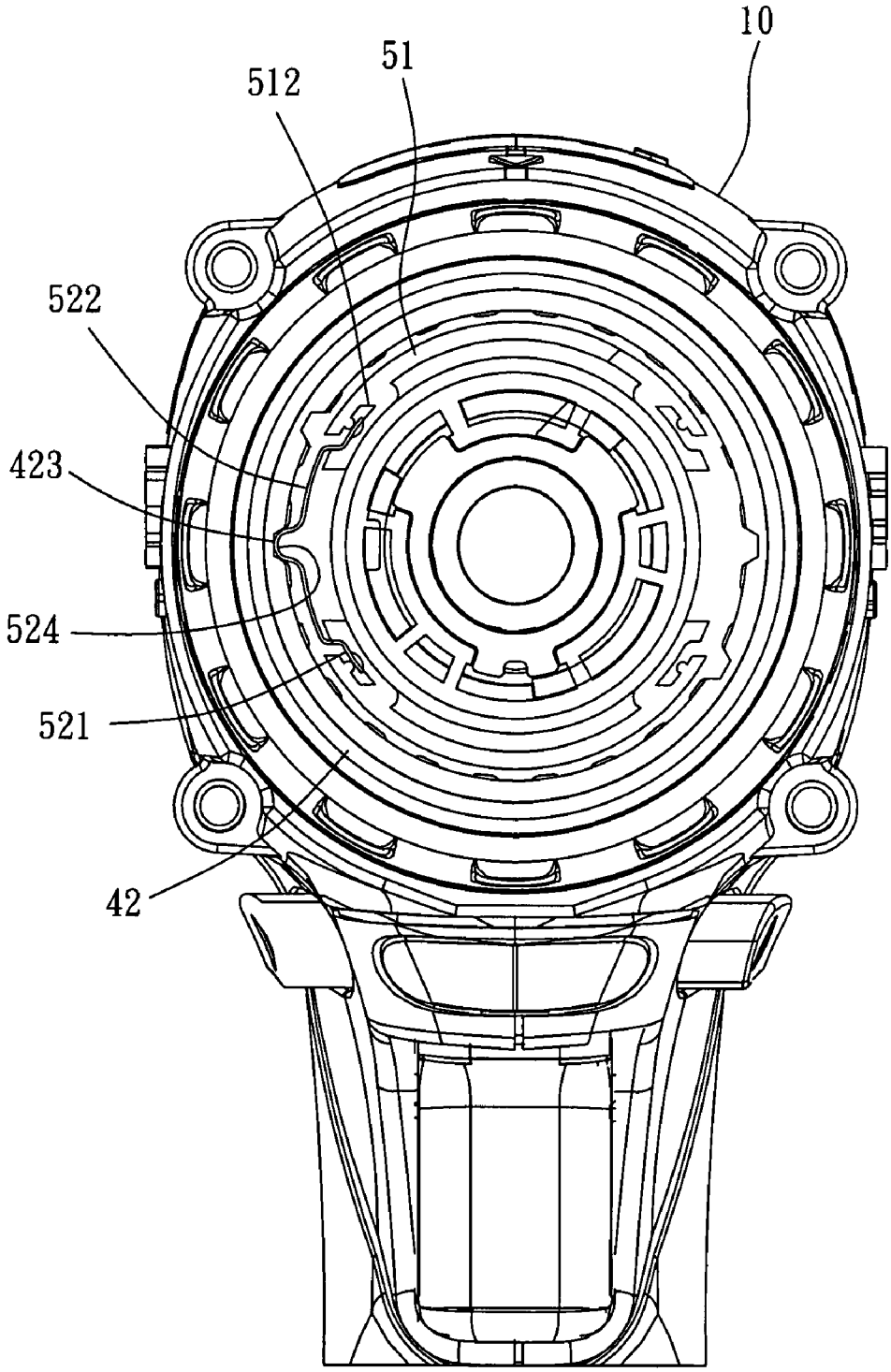
FIG. 4 is a sectional view taken from a line 4-4 indicated in FIG. 2.

Referring to FIGS. 1-4, a power hand tool 100 of a preferred embodiment of the present invention is composed of a housing 10, an electric motor (not shown), a battery pack (not shown), a transmission gear set (not shown), a torsion control device 30, an impact device 40, and a locating device 50.

The housing 10 includes a first semi-shell 11, a second semi-shell 12, a washer 13, and a C-shaped Ring 14. The first and second semi-shells 11 and 12 are butted with each other.

The electric motor is fixed in the housing for providing a rotary motion.

The battery pack is detachably mounted to the housing 10 for providing power for the electric motor.

The transmission gear set is mounted in the housing 10 and connected in transmission with the electric motor, for decelerating the rotary motion provided by the electric motor down to a predetermined speed and then outputting it via an output shaft 21.

The torsion control device 30 includes a base 31, a rotary disk 32, and a first rotary knob 33. The base 31 is located in the housing 10 and connected with the transmission gear set. The rotary disk 32 is mounted to the base 31, axially movable along the output shaft 21 and rotatable on a rotary center of the output shaft 21, for adjusting the maximum torsion of the output shaft 21 via the axial movement of the rotary disk 32. The base 31 has an annular groove 311 formed on an external periphery thereof. The rotary disk 32 has a plurality of recesses 321 formed axially on an external periphery thereof. The first rotary knob 33 is mounted to the housing 10 and rotatable on the rotary center of the output shaft 21. The first rotary knob 33 has an internal periphery 331, a retaining wall 331 protruding outward from the internal periphery thereof, and a plurality of ribs 332 corresponding to the recesses 321 respectively and formed on the internal periphery thereof at one side of the retaining wall 331. The ribs 332 can be axially inserted in the recesses 321, so the rotary disk 32 can be axially moved, with respect to the first rotary knob 33, via the recesses 321 along the ribs 332 and be driven for rotation together while the first rotary knob is turned. A plurality of first dents 333 are annularly formed on the internal periphery at the other side of the retaining wall 331.

The impact device 40 includes a switch 41 and a second rotary knob 42. The switch 41 is mounted in the housing 10 and can be operated for reciprocating motion on the rotary center of the output shaft 21. One of the reciprocating motion of the impact device 40 can switch on or off an impact motion generated on the output shaft 21. The second rotary knob 42 has a coordinating hole 421 and a receiving hole 422. The coordinating hole 421 is located at an axis of the second rotary knob 42, corresponding to the shape of the switch 41. The receiving hole 422 is located around the coordinating hole 421. The second rotary knob 42 is mounted to the housing 10, allowing the switch 41 to be engaged with the coordinating hole 421 for driving rotation of the switch 41 while the second rotary knob 42 is turned on the rotary center of the output shaft 21. The base 31 of the torsion control device 30 is inserted into the receiving hole 422. Because the diameter of the receiving hole 422 is larger than the profile of the base 31, i.e. there is a predetermined gap formed between the base 31 and the sidewall of the receiving hole 422, it prevents the sidewall of the coordinating hole 422 from driving motion of the base 31 or from interference with the base 31 while the second rotary knob 42 is turned to drive rotation of the switch 41. The second rotary knob 42 has an internal periphery and a plurality of second dents 423 annularly formed on the internal periphery thereof. In addition, the C-shaped ring 14 of the housing 10 is jammed in the annular groove 311 of the base 31, and the washer 13 is closely mounted between the C-shaped ring 14 and an external end face of the second rotary knob 42, so the C-shaped ring 14 restricts the axial motion of the first and second rotary knobs 33 and 42.

The locating device 50 includes a holder 51 and a locating member 52. The holder 51 has a locating hole 511 formed at an axis thereof and corresponding in shape to the base 31 of the torsion control device 30. The holder 51 is located between the first and second knobs 33 and 42, the base 31 mounted in the locating hole 511 and the holder 51 fixedly connected with the base 31. The holder 51 has two slots 512 formed on an external periphery thereof and spaced from each other. The locating member 52 has two base portions 521 separate from each other, and two resilient portions 522 parallel located between the two base portions 521. Each of the two resilient potions 522 has a first convexity 523 and a second convexity 524. The two base portions 521 of the locating member 52 are inserted in the two slots 512 of the holder 51 respectively. The two resilient portions 522 face the internal peripheries of the first and second rotary knobs 33 and 42 respectively. The first and second convexities 523 and 524 of the two resilient portions 522 are engaged with the first dents 333 or the second dents 423. Accordingly, while the first rotary 33 or the second rotary knob 42 is turned, the first and second convexities 523 and 524 of the two resilient portions 522 are engaged in the associated first dents 333 or the associated second dents 423 respectively, thus adjusting the torsion output and switching on or off the impact motion.

In conclusion, the power hand tool of the present invention not only provides the torsion control and the impact functioned by the torsion control device and the impact device respectively at the same time, but also shares the same locating device for the torsion control and impact devices to decrease required elements and size thereof.

Although the present invention has been described with respect to a specific preferred embodiment thereof, it is no way limited to the details of the illustrated structures but changes and modifications may be made within the scope of the appended claims.

What is claimed is:

1. A power hand tool comprising:

a housing;

an electric motor mounted in said housing for providing a rotary motion;

a transmission gear set having an output shaft and mounted in said housing and connected with said electric motor for decelerating the rotary motion of said electric motor down to a predetermined speed and then outputting it via said output shaft;

a torsion control device having a base, a rotary disk, and a first rotary knob, said base being connected with said transmission gear set and located in said housing, said rotary disk being mounted to said base, said rotary disk being rotatable on a rotary center of said output shaft, said rotary disk being axially movable along said output shaft for adjusting the maximum torsion output of said output shaft, said first rotary knob being mounted to said housing for rotation on the rotary center of said output shaft and connected with said rotary disk for driving rotation of said rotary disk while being turned, said first rotary knob further having an internal periphery and a plurality of dents formed on the internal periphery thereof;

an impact device having a switch and a second rotary knob, said switch being mounted in said housing for reciprocating rotation on the rotary center of said output shaft, whereby one of the reciprocating rotation can switch on or off an impact motion formed from said output shaft, said second rotary knob being mounted to said housing for rotation on the rotary center of said output shaft and being connected with said switch for driving rotation of said switch while being turned, said second rotary knob further having an internal periphery and a plurality of second dents formed on the internal periphery thereof; and a locating device having a holder and a locating member, said holder being fixed to said base of said torsion control device, said locating member having two separate base portions and two resilient portions parallel located between said two base portions, each of said resilient portions having a convexity, said base portions of said locating member being mounted to said holder, said two resilient portions facing internal peripheries of said first and second rotary knobs respectively, said convexities of said resilient portions being engaged with said first dents or said second dents, whereby while said first rotary knob or said second rotary knob is turned, said convexities of said resilient portions are engaged with the associated said first dents or said second dents.

2. The power hand tool as defined in claim 1 further comprising a battery pack, said battery pack being detachably mounted to said housing for providing power for said electric motor.

3. The power hand tool as defined in claim 1, wherein said housing further comprises a C-shaped ring; said base of said torsion control device further comprises an annular groove, said C-shape ring being engaged in said annular groove to avoid axial movement of said first and second rotary knobs.

4. The power hand tool as defined in claim 1, wherein said rotary disk further comprises a plurality of recesses axially formed on an external periphery thereof; said first rotary knob further comprises a plurality of ribs formed on the internal periphery thereof and corresponding to said recesses of said rotary disk, said ribs being inserted into said recesses respectively, said rotary disk being axially movable with respect to said first rotary knob via said recesses along said ribs.

5. The power hand tool as defined in claim 1, wherein said second rotary knob further comprises a coordinating hole located an axis thereof and corresponding to the shape of said switch, said switch being inserted in said coordinating hole, whereby while said second rotary knob is turned on the rotary center of said output shaft, said switch can be driven for rotation by the sidewall of said coordinating hole.

6. The power hand tool as defined in claim 5, wherein said second rotary knob further comprises at least one receiving hole formed around said coordinating hole; said base of said torsion control device is inserted in said receiving hole, a gap being formed between the sidewall of said receiving hole and the base, whereby while said second rotary knob is turned to drive rotation of said switch, the sidewall of said receiving hole does not interfere with said base.

7. The power hand tool as defined in claim 1, wherein said holder further comprises a locating hole formed at an axis thereof and corresponding to the shape of said base and is located between said first and second rotary knobs; said base is inserted in said locating hole, whereby said holder is fixedly connected with said base.

8. The power hand tool as defined in claim 1, wherein said holder further comprises two spaced slots formed on an external periphery thereof; said two base portions of said locating member are inserted in said two slots respectively.

* * * * *